United States Patent [19]

Rahman et al.

[11] 4,027,547

[45] June 7, 1977

[54] SINGLE LEVER CONTROL

[75] Inventors: Habibur Rahman, Detroit; Gerald L. Joslyn, Auburn Heights, both of Mich.

[73] Assignee: Massey-Ferguson Inc., Detroit, Mich.

[22] Filed: Dec. 17, 1975

[21] Appl. No.: 641,707

[52] U.S. Cl. ..... 74/471 XY; 137/636.2
[51] Int. Cl.[2] ..... G05G 9/00; G05G 9/04
[58] Field of Search ..... 74/471, 471 XY; 200/6 A; 137/636.2

[56] References Cited

UNITED STATES PATENTS

| | | | |
|---|---|---|---|
| 3,625,082 | 12/1971 | Muller et al. | 74/471 XY |
| 3,831,633 | 8/1974 | Comer | 74/471 XY X |

*Primary Examiner*—Samuel Scott
*Assistant Examiner*—Frank H. McKenzie, Jr.
*Attorney, Agent, or Firm*—Thomas P. Lewandowski

[57] ABSTRACT

A single lever control for actuating a pair of adjacent mechanisms such as valves spools in which a pair of actuating arms are supported for pivotal movement about intersecting axes and in which a control lever is supported for universal movement about the intersection of the axes for transmitting movement to both or to a selected one of the actuating arms.

11 Claims, 5 Drawing Figures

SINGLE LEVER CONTROL

This invention relates to single lever control mechanisms and in particular to a single lever control which can selectively and simultaneously control multiple movements.

In certain types of equipment such as a backhoe, for example, it is desirable to control a number of functions such as the elevation and swing of a boom and the angular displacement of the dip stick relative to the boom or the tilting of a bucket on the end of the dip stick. Since some of these operations are interrelated it has been found convenient to control such operations as the elevation and swing of the boom by a single lever control and the angular displacement of the dip stick and of the bucket by another single lever control. Prior attempts to achieve single lever control have resulted in arrangements which are bulky, complex and expensive to manufacture. In addition such controls are normally required to be positioned at a considerable distance from the valve mechanisms which are to be actuated. Still a further problem is that the movement required to control one valve mechanism is different than the movement required to control the other valve mechanism so that a smooth feel or reaction is not sensed by the operator during manipulation of the single lever control.

It is an object of the invention to provide a compact, simple and economical single lever control adapted to actuate two or more mechanisms such as valves employed in a hydraulic control system.

Still another object of the invention is to provide a single lever control in which movement of the lever to operate a pair of valve mechanisms occurs about intersecting axes and movement of the lever is transmitted through equal length lever arms to the mechanisms to be actuated to produce proportionate movement of the mechanisms to the movement of the control lever in either of its directions. A single lever control of the present invention includes a stationary support for pivotally supporting a pair of actuating arms for pivotal movement in opposite directions from a neutral position about axes which are disposed in a common plane and at right angles to each other. The actuating arms are connected to a control lever which may be pivoted about a third axes relative to one of the actuating arms. The axes are so arranged that movement of the control lever about one axes has no effect on the valve associated with the other axes as a consequence of which the valves may be individually and separately controlled if desired or may be controlled simultaneously, all through a single lever. FIG. 1 is a side elevation of a single lever control embodying the invention;

Figure 1:
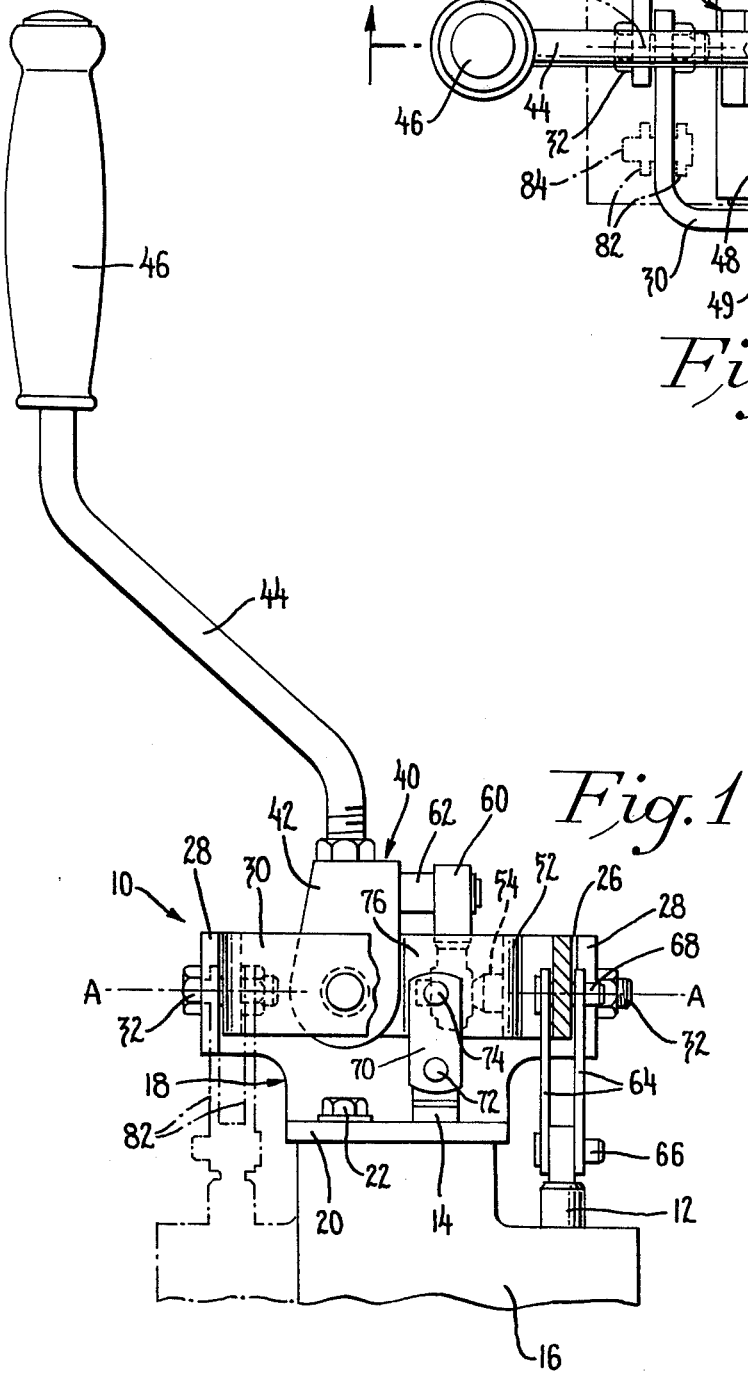
Figure 3:
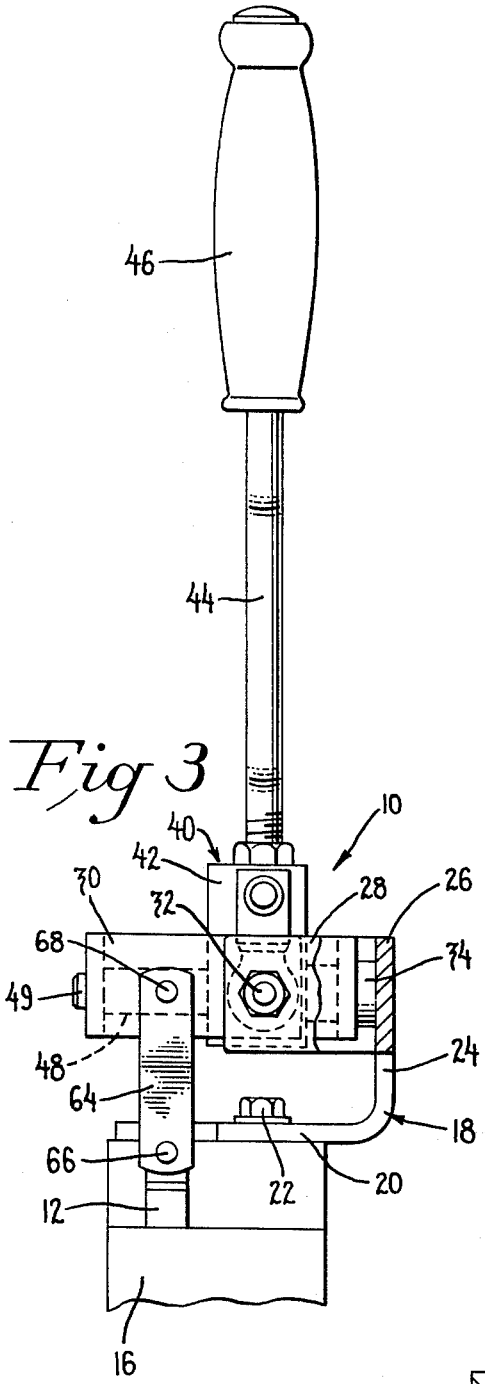
FIG. 3 is a side elevation of the single lever control seen in FIG. 1.
Figure 4:
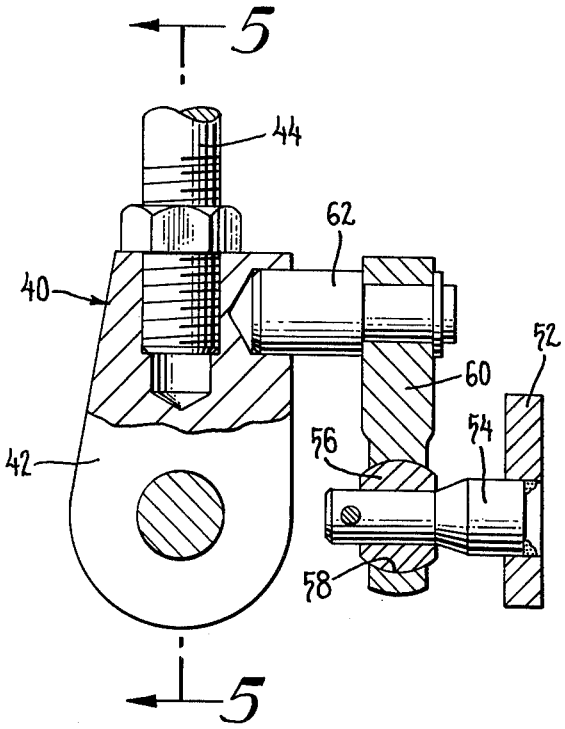
FIG. 4 is a sectional view taken generally on line 4—4 in FIG. 2.
Figure 5:
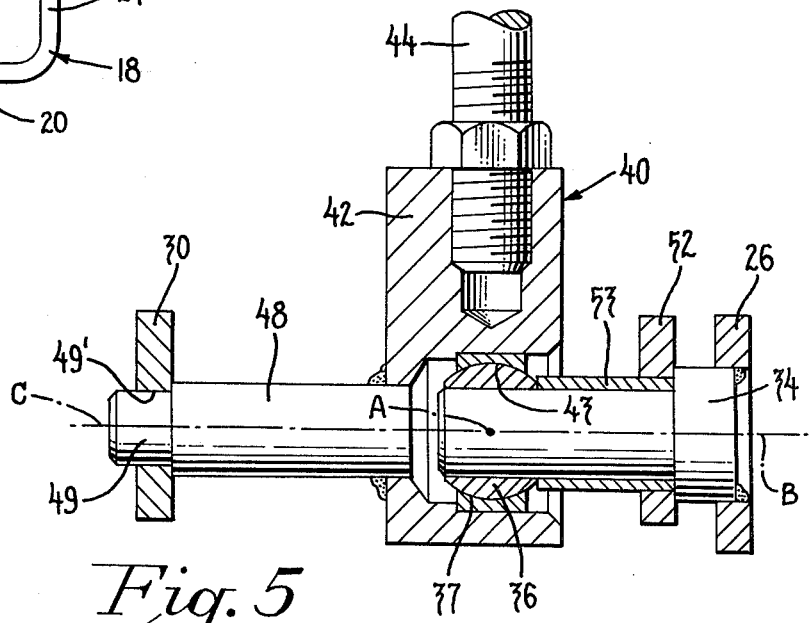

FIG. 5 is a sectional view taken on line 5—5 in FIG. 4. A single lever control embodying the invention is designated at 10 and is shown in position for operating a pair of mechanisms represented by the spool 12 and spool 14 of a pair of self centering valves in a valve manifold 16. The valve manifold 16 is connected to a source of hydraulic pressure and manipulation of the single lever control 10 moves the spools 12 and 14 in opposite directions from a neutral, self-centered position to cause hydraulic fluid to be delivered or exhausted from hydraulically actuated mechanisms such as hydraulic motors associated with the dip stick and bucket of a backhoe, none of which are shown. In the present instance, the spools 12 and 14 are disposed in side by side relationship to move on parallel axes and as seen in FIG. 1, the upper end of the spool 12 is disposed at a lower level than the upper end of the spool 14. It will be understood, however, that the spool ends can be at substantially the same level and also that the spools can actuate other mechanisms such as electrical devices instead of hydraulic valves.

The single lever control 10 includes a base structure 18 which includes a flat base member 20 connected by the means of bolts 22 through the top of the valve manifold 16 adjacent to the spools 12 and 14.

The base 20 of the mounting structure 18 has an upturned portion or a vertical wall 24, the upper end of which forms a U-shaped bracket 26 having spaced parallel legs 28. The ends of the legs 28 pivotally support an arm or bale member 30 by means of a pair of shouldered bolts 32 which form a pivot axis for the bale member 30 relative to the U-shaped bracket 26 which is held in stationary position relative to the valve manifold 16. The axis of bale member 30 formed by bolts 32 is identified as axis A.

A post 34 has one end rigidly connected to the U-shaped bracket 26 and extends between and generally parallel to the legs 28. The free end of the post 34 supports a bearing member 36 which as seen in FIG. 5 has a spherical bearing surface 37 with its center on the axis A of the bolts 32.

The bearing member 36 supports a lever assembly 40 including a housing 42 which forms a socket having a concave bearing surface 43 for receiving the spherical surface 37 of the bearing member 36. The upper end of the housing 42 threadably receives the lower end of a control lever 44 the upper end of which is provided with a hand grip 46 by which the lever 44 and the lever assembly 40 may be moved relative to the bearing member 36.

Figure 2:
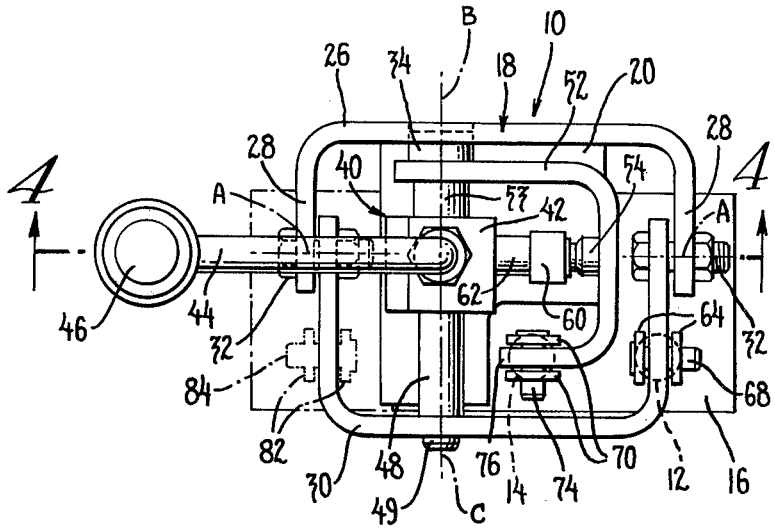
FIG. 2 is a plan view of the single lever control shown in FIG. 1.

As best seen in FIGS. 2 and 5 housing 42 has a stub shaft 48 projecting to one side and rigidly connected to the lever housing 42. A free end 49 of the shaft 48 is of reduced diameter and is rotatably supported in an opening 49' of the bale member 30 so that the lever assembly 40 may be pivoted about the axis of the shaft 48 and relative to the bearing member 36 and bale member 30.

A control arm 52, which as seen in FIG. 2 has a generally C-shaped configuration, is provided with a boss 53 journaled on the post 34 between the U-bracket 26 and the bearing member 36 so that the control arm 52 may pivot about the axis of the post 34.

An intermediate portion of the control arm 52 rigidly supports one end of a post 54 the free end of which is reduced in diameter and supports a bearing element 56 presenting spherical bearing surfaces. The ball 56 is seated in a socket 58 at the lower end of a link 60 to form a universal connection between the latter and the post 54. The upper end of the link 60 is pivotally connected on a stub shaft 62 for pivotal movement about an axis parallel to the axis of the bolts 32 supporting the bale member 30 when the lever control 10 is in the position shown in the drawings.

The spool member 12 is connected to the bale member 30 by a pair of links 64 the lower ends of which are pivotally connected by means of a pin 66 to the upper end of the spool 12. The upper end of the links 64 are pivotally connected to an intermediate portion of one of the legs 29 of the bale member 30 by means of a pin 68. Similarly, the spool 14 is connectd to the control arm 52 by a pair of links 70 having their lower ends connected by a pin 72 to the spool 14. The upper ends of the links 70 are pivotally connected by means of a pin 74 to an end portion 76 of the C-shaped control arm 52.

Movement of the spool 12 is brought about by movement of the bale member 30 about the axis formed by the bolts 32 which in the drawing is designated as axis A. Movement of the spool 14 is brought about by movement of the control arm 52 about the axis of the post 34 which in the drawings is designated as axis B and extends from the center of the bearing member 36 and axially of the post 34.

The hand lever 44 is used to transmit manual movement of the operator to the U-shaped bale member 30 or to the C-shaped control arm 52. The lever 44 transmits its motion to the bale member 30 by means of angular displacement of the shaft 48 connected to the lever housing 42 when the lever 44 is moved in a fore-and-aft direction about axis A. During such movement the control arm 52 remains stationary relative to axis B. Movement of the lever assembly 40 about the center of the bearing member 36 and on the axis A also results in angular movement of the link 60 relative to the bearing 56 and socket 58. However, since the distances of the center of the ball shaped bearing member 36 and the bearing 56 to the axis of stub shaft 62 are the same, movement of the lever about axis A does not result in any movement of the control arm 52.

Movement of the control arm 52 is accomplished by moving the lever 44 from side to side about the axis of the shaft 48 which extends from the center of the bearing member 36 and axially of the shaft 48 and in the drawing is designated as axis C. Such side to side movement of the lever 44 causes motion of the lever assembly 40 to be transmitted through the stub shaft 62 to the bearing and socket connection 56, 58 and therefrom to the control arm 52, to pivot the latter on post 34 and about axis B.

It will be understood that when the bale member 30 has been pivoted about the axis A, the lever 44 may be moved from side to side about axis C to bring about movement of the control arm 52 about axis B. Moreover, fore-and-aft motion and side to side motion of the lever may be executed simultaneously or separately to bring about simultaneous or selected separate operation of the spools 12 and 14.

During all control movements of the spool 12, the distance between the axis A and the axis of pin 68 to spool 12 remains fixed and proportional (equal in the embodiment illustrated) to the distance between axis B and the axis of pin 74. As a consequence of this relationship, an increment of fore-and-aft movement will result in a proportional control movement at the spool 14. The operating effect of this relationship is that with mechanisms such as the spools 12 and 14 offering equal resistances, the feel experienced by an operator in manipulating the control lever 44 is uniform in all directions of operation.

In the position shown in the drawings the control lever 44 and the attached control arms 30 and 52 are in their neutral position with the valve spools 12 and 14 in their neutral, centered position. The lever 44 may be moved in opposite directions from the neutral position about the axis A and also in opposite directions from the neutral position about the axis C. As viewed in FIG. 2, angular movement of the lever 44 will result in a simultaneous movement of arm 30 about axis A and arm 52 about axis B.

As seen in FIG. 2, the spools 12 and 14 are positioned in side by side relationship with the axis C to one side of both of the spools 12 and 14. However, if desired the single lever control 10 may be used with spaced apart valves in which a pair of links 82 may be substituted for the links 64 and be pivotally connected by a pin 84 to the other leg of the bale member 30. The lower ends of the links 82 may be pivotally connected to the upper end of a spool valve, not shown. With this arrangement the spools of a pair of valve mechanisms will be disposed at opposite sides of the axis C but the same form of single lever control is maintained since the axis of the pin 84 is spaced from axis A a distance equal to the spacing of the pin 74 from axis B.

A single lever control is provided in which a pair of mechanisms are actuated either simultaneously or separately by movement of the lever about the selected one or simultaneously about both of a pair of axes which intersect each other. The connection between the mechanisms to be actuated and the single lever control is such that equal increments of movement of the control lever about either of the two axes results in equal increments of movement of the mechanisms to be controlled and as a consequence, a uniform control is experienced by an operator manipulating the single lever control.

The embodiments of the invention in which an exclusive property or privilege is claimed are defined as follows:

1. A single lever control for operating two separate mechanisms comprising; a base structure adapted to be supported adjacent said mechanisms, a first arm member mounted on said base structure for pivotal movement about a first axis disposed in fixed relation to said base structure, a second arm member mounted on said base structure for pivotal movement about a second axis disposed in fixed relation to said base structure and intersecting said first axis, a shaft forming a third member having one end supported at the intersection of the first and second axes and the other end supported on said first arm member for rotational movement about a third axis, a control lever rigidly connected to said shaft member for rotational movement of the latter on the third axis and for angular displacement of said shaft member about the first axis during movement of said control lever from a neutral position in which said first, second and third members are disposed in a common plane, means connecting said control lever to said second arm member to move the latter to selected positions about the second axis upon movement of said control lever about the third axis, said second arm member remaining in its selected position upon movement of said first arm member about the first axis, first and second connecting means mounted on said first and second arm members, respectively, for movement in generally parallel paths in a plane parallel to said first axis and being adapted for connection to said mechanisms for selective or simultaneous movement upon movement of said control lever about the first and third axes.

2. The combination of claim 1 in which all of said axes are disposed in a common plane when said lever is in said neutral position.

3. The combination of claim 1 in which said second and third axes are aligned with each other when said lever is in said neutral position.

4. The combination of claim 1 in which said first and second axes intersect each other at right angles.

5. The combination of claim 1 in which the intersection of said first and second axes has a universal connection device rigidly connected to one end of said lever and to one end of said shaft member.

6. The combination of claim 1 in which said single lever control is connected to separate mechanisms each of which comprises a self centering valve member and in which said mechanisms resiliently urge said control lever to its said neutral position.

7. The combination of claim 1 in which said first connecting means is disposed in spaced relationship to said first axes and in which said second connecting means is disposed in equally spaced relationship to said second axis.

8. The combination of claim 1 in which said second axis is formed by a post rigidly connected to said base structure and in which said first axis passes through an end portion of said post.

9. The combination of claim 8 in which a universal connection device is supported at said end portion.

10. The combination of claim 1 in which said means connecting said control lever to said second arm member includes a ball and socket connection.

11. The combination of claim 10 in which said means connecting said control lever to said second arm member includes a link pivotally connected at one end to said control lever in spaced relationship to said first axis and in which the other end of said link terminates in said ball and socket connection.

* * * * *